US006681172B2

(12) United States Patent
Pfeiffer et al.

(10) Patent No.: US 6,681,172 B2
(45) Date of Patent: Jan. 20, 2004

(54) MODEL-BASED METHOD OF ESTIMATING CRANKCASE OIL TEMPERATURE IN AN INTERNAL COMBUSTION ENGINE

(75) Inventors: Jeffrey M. Pfeiffer, Walled Lake, MI (US); Joon-Ho Yoo, Ann Arbor, MI (US)

(73) Assignee: Delphi Technologies, Inc., Troy, MI (US)

( * ) Notice: Subject to any disclaimer, the term of this patent is extended or adjusted under 35 U.S.C. 154(b) by 144 days.

(21) Appl. No.: 10/079,965

(22) Filed: Feb. 21, 2002

(65) Prior Publication Data

US 2002/0161508 A1 Oct. 31, 2002

Related U.S. Application Data

(60) Provisional application No. 60/286,591, filed on Apr. 26, 2001.

(51) Int. Cl.[7] ..... G06G 7/70; F01M 11/00

(52) U.S. Cl. ..... 701/113; 73/117.3

(58) Field of Search ..... 701/101, 102, 701/103, 113; 700/28, 29; 123/90.11, 90.12, 90.15, 90.16, 90.17, 90.18, 196 R, 196 AB, 339.22, 339.24; 73/116, 117.3

(56) References Cited

U.S. PATENT DOCUMENTS 5,002,026 A * 3/1991 Ohkumo et al. ..... 123/339.22
6,446,588 B2 * 9/2002 Yamada et al. ..... 123/90.11
6,449,538 B1 * 9/2002 Kubo et al. ..... 73/117.3
6,505,585 B1 * 1/2003 Machida et al. ..... 123/90.17

FOREIGN PATENT DOCUMENTS

JP 2001182565 A * 7/2001 ..... 123/90.16

* cited by examiner

*Primary Examiner*—Willis R. Wolfe
(74) *Attorney, Agent, or Firm*—Jimmy L. Funke

(57) ABSTRACT

An improved method of estimating the oil temperature of an internal combustion engine models the net heat flow through the oil during operation of the engine based on known engine operating parameters and integrates the net heat flow to update the oil temperature estimate. The net heat flow components include heat added to the oil due to fuel combustion and heat rejected from the oil to the engine coolant and atmospheric air, and are based on heat transfer coefficients that are adjusted to take into account variations in engine speed, vehicle speed and cooling fan operation.

10 Claims, 1 Drawing Sheet

MODEL-BASED METHOD OF ESTIMATING CRANKCASE OIL TEMPERATURE IN AN INTERNAL COMBUSTION ENGINE

This application claims the benefit of Provisional application No. 60/286,591 filed Apr. 26, 2001.

TECHNICAL FIELD

The present invention relates to a model-based method of estimating the crankcase oil temperature of an internal combustion engine.

BACKGROUND OF THE INVENTION

Crankcase oil is utilized in internal combustion engines for both lubrication and cooling, and an accurate indication of the oil temperature is useful for control purposes such as estimating the viscous friction of the engine and the response time of oil-activated actuators. Although the oil temperature may be measured directly with a dedicated sensor, most automotive manufacturers have relied on an estimate of the oil temperature in order to save the cost of the sensor. For example, the oil temperature can be estimated based on the engine coolant temperature or inferred based on various engine response time measurements. However, these techniques typically require extensive calibration effort, and often provide only a rough estimate of the oil temperature. Accordingly, what is needed is an estimation method for use in production applications that is simple to implement and that provides a more accurate estimation of the engine oil temperature.

SUMMARY OF THE INVENTION

The present invention is directed to an improved method of estimating the crankcase oil temperature of an internal combustion engine by modeling the net heat flow through the oil during operation of the engine based on known engine operating parameters and integrating the net heat flow to update the oil temperature estimate. The net heat flow components include heat added to the oil due to fuel combustion and heat rejected from the oil to the engine coolant and atmospheric air, and are based on heat transfer coefficients that are adjusted to take into account variations in engine speed, vehicle speed and cooling fan operation.

DESCRIPTION OF THE PREFERRED EMBODIMENT

Figure 1:
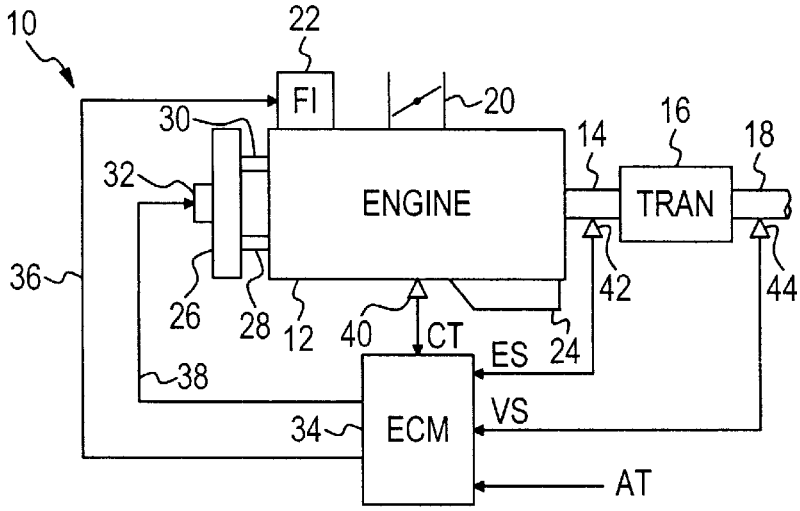
FIG. 1 is a diagram of a typical motor vehicle internal combustion engine and a microprocessor-based engine control module programmed to carry out the temperature estimation method of this invention.

Referring to FIG. 1, the reference numeral 10 generally designates a powertrain for a motor vehicle, including an internal combustion engine 12 having an output shaft 14 and a power transmission 16 coupling engine output shaft 14 to a drive shaft 18. The engine 12 includes a throttle valve 20 through which intake air is ingested, and a fuel injection (FI) system 22 for injecting a precisely controlled quantity of fuel for mixture with the intake air and combustion in the engine cylinders (not shown).

Crankcase oil is circulated through a series of internal passages for lubricating moving parts of engine 12 and removing heat generated due to combustion and friction. Heat added to the engine oil is transferred to the atmosphere primarily due to passage of ambient air across the oil pan 24 and to engine coolant that is pumped through the engine water jacket to regulate the engine operating temperature. A radiator 26 coupled to the engine water jacket via hoses 28 and 30 transfers engine coolant heat to the atmosphere, and an electrically driven fan 32 can be turned on to increase the heat transfer rate.

As indicated in FIG. 1, the fuel injection system 22 and cooling fan 32 are controlled by a microprocessor-based engine control module (ECM) 34 via lines 36 and 38 in response to various inputs such as engine speed ES and coolant temperature CT, which may be obtained with conventional sensors 42 and 40. Additionally, ECM 34 receives a vehicle speed (VS) input based on a drive shaft speed sensor 44, and an ambient air temperature (AT) signal.

Figure 2:
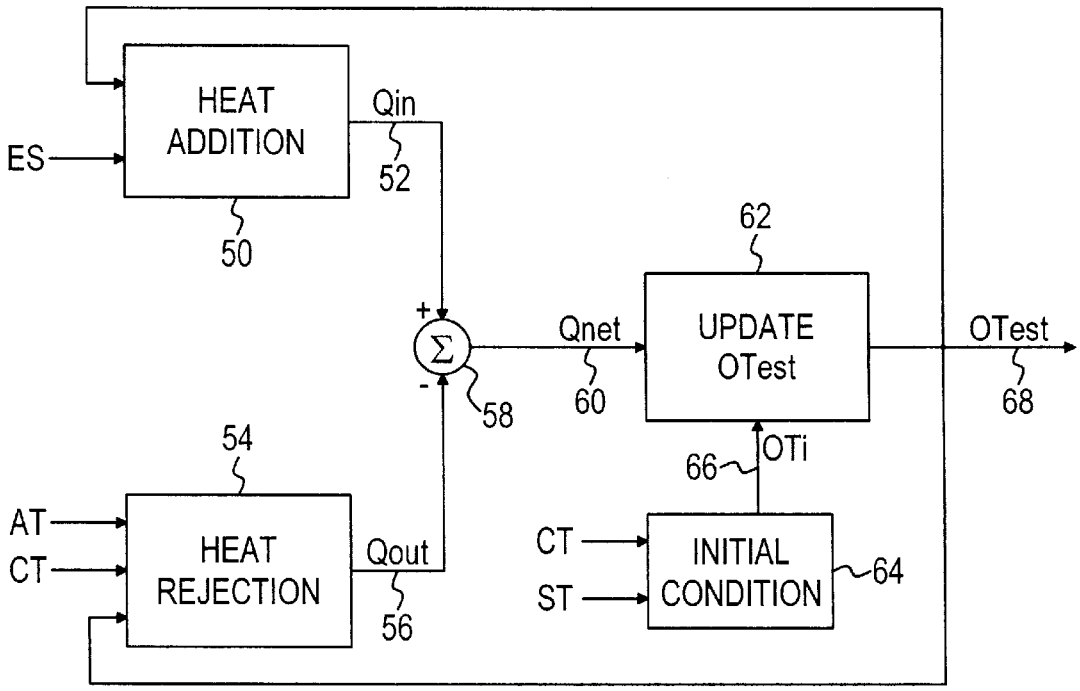
FIG. 2 is a block diagram representative of a software routine executed by the engine control module of FIG. 1 in carrying out the temperature estimation method of this invention.

The present invention is directed to a method of operation carried out by ECM 34 for estimating the temperature of the engine oil by modeling the net heat flow through the oil during operation of engine 12 based on the above-mentioned commonly available engine operating parameters and integrating the net heat flow to update the oil temperature estimate. The estimation method is outlined by the block diagram of FIG. 2, where the engine speed ES, the ambient air temperature AT, the coolant temperature CT and the engine soak time ST are provided as inputs for determining the estimated oil temperature OTest. In general, the net heat flow Qnet through the engine oil is determined according to the difference between the heat added to the oil by combustion of the air/fuel mixture and the heat rejected from the engine oil to the engine coolant and the atmosphere. Block 50 determines the heat flow Qin into the oil as a function of engine speed ES and the most recent oil temperature estimate $OTest_{k-1}$. In particular, the heat flow Qin is determined as follows:

$$Qin=h_{comb}*(T_{comb}-OTest_{k-1})$$

where $h_{comb}$ is the combustion-to-oil heat transfer coefficient and $T_{comb}$ is the temperature of combustion. Both $h_{comb}$ and $T_{comb}$ may be empirically determined for a given engine design, and $h_{comb}$ is preferably scheduled as a function of engine speed ES to take into account the variations in engine oil flow velocity. Block 54 determines the heat flow Qout out of the engine oil as a function of the ambient air temperature AT, the coolant temperature CT and the most recent oil temperature estimate $OTest_{k-1}$. In particular, the heat flow Qout is determined according to the sum of the heat flows into the engine coolant and the atmosphere, as follows:

$$Qout=[h_{cool}*(OTest_{k-1}-CT)]+[h_{air}*(OTest_{k-1}-AT)]$$

where $h_{cool}$ is the oil-to-coolant heat transfer coefficient and $h_{air}$ is the oil-to-atmosphere heat transfer coefficient. As with $h_{comb}$, $h_{cool}$ is preferably scheduled as a function of engine speed ES to take into account the variations in engine coolant flow velocity. Additionally, the determined value of $h_{cool}$ is preferably adjusted by vehicle speed and cooling fan multipliers Mvs, Mcf to take into account the variations in heat transfer that occur with variations in vehicle speed above a calibrated value and the operating state (on/off) of cooling fan 32. The vehicle speed multiplier Mvs is also applied to the oil-to-atmosphere heat transfer coefficient $h_{air}$, along with an idle state multiplier Mis that takes into account the tendency of engine 12 to heat up more at engine idle. That is, the adjusted values $h_{cool}'$ and $h_{air}'$ may be given as:

$$h_{cool}'=h_{cool}*Mvs*Mcf$$

$$h_{air}'=h_{air}*Mvs*Mis$$

where Mvs is a function of vehicle speed VS, Mcf is a function of cooling fan state, and Mis is a function of engine idle state and coolant temperature CT during engine idling.

The summer 58 reduces the incoming heat flow Qin on line 52 by the outgoing heat flow Qout on line 56 to form the net heat flow Qnet on line 60. The block 62 uses the net heat flow Qnet along with an estimate of the initial (i.e., start-up) temperature OTi of the engine oil to update the current estimate OTest. The initial temperature OTi is determined at block 64 as a function of the coolant temperature CT and the engine soak time ST, where soak time ST can be defined as the engine-off interval prior to the current period of engine operation. Essentially, if ST is greater than a calibrated reference, OTi is set equal to the initial (start-up) coolant temperature CTi; otherwise, OTi can be estimated as a function of ST and CTi. Finally, block 62 updates the oil temperature estimate OTest according to:

$$OTest=OTi+K*INT(Qnet)$$

where K is a constant equal to $1/(m_{oil}*cp_{oil})$, $m_{oil}$ is the mass of the engine oil, and $cp_{oil}$ is the heat capacity of engine oil, and INT is an integral function. The integral function can obviously be implemented in discrete form, and the updated value of OTest becomes the most recent temperature estimate $OTest_{k-1}$ in the next execution of the routine.

In summary, the present invention provides an easily implemented and reliable estimate of the crankcase oil temperature in an internal combustion engine by modeling the net heat flow through the oil during operation of the engine based on known engine operating parameters and integrating the net heat flow to update the oil temperature estimate. While the invention has been described in reference to the illustrated embodiment, it is expected that various modifications in addition to those mentioned above will occur to those skilled in the art. For example, the various input values to ECM 34 may be estimated instead of measured, and so on. Thus, it will be understood that methods incorporating these and other modifications may fall within the scope of this invention, which is defined by the appended claims.

What is claimed is:

1. A method of estimating a temperature of crankcase oil in an internal combustion engine, comprising the steps of:

determining an initial estimate of the oil temperature at engine start-up based on a duration of engine inactivity prior to said engine start-up;

modeling a net heat flow through the oil during operation of the engine after start-up; and periodically determining a new estimate of the oil temperature based on the initial estimate and the modeled net heat flow.

2. The method of claim 1, wherein the step of modeling the net heat flow comprises the steps of:

modeling a heat flow into the oil from combustion of an air/fuel mixture in the engine;

modeling a heat flow out of the oil; and modeling the net heat flow according to a difference between the modeled heat flow into the oil and the modeled heat flow out of the oil.

3. The method of claim 2, wherein the heat flow into the oil is modeled as a function of the oil temperature estimate, an estimate of a combustion temperature of said air/fuel mixture, and an empirically determined heat transfer coefficient.

4. The method of claim 3, wherein said heat transfer coefficient is empirically determined as a function of a speed of said engine.

5. The method of claim 2, wherein the heat flow out of the oil is modeled as a summation of a heat flow from the oil to atmospheric air and a heat flow from the oil to an engine coolant, the heat flow to atmospheric air being modeled as a function of the oil temperature estimate, a temperature of atmospheric air and an oil-to-air heat transfer coefficient, and the heat flow to the engine coolant being modeled as a function of the oil temperature estimate, a temperature of the coolant and an oil-to-coolant heat transfer coefficient.

6. The method of claim 5, where the engine is installed in a motor vehicle, and the oil-to-coolant heat transfer coefficient is empirically determined as a function of a speed of said engine, a speed of the motor vehicle and a heat transfer rate of the coolant to atmospheric air.

7. The method of claim 6, wherein the heat transfer rate of the coolant to atmospheric air is determined as a function of an operating state of a fan that forces atmospheric air through a coolant radiator.

8. The method of claim 5, where the engine is installed in a motor vehicle, and the oil-to-air heat transfer coefficient is adjusted as a function of a speed of the motor vehicle.

9. The method of claim 8, including the steps of:

detecting an engine idle condition; and adjusting the oil-to-air heat transfer coefficient as a function of the coolant temperature when said engine idle condition is detected.

10. The method of claim 1, wherein the step of periodically determining a new estimate of the oil temperature includes the steps of:

estimating a change in oil temperature due to the modeled net heat flow; and determining the new estimate of oil temperature according to a sum of the initial estimate and the estimated change in oil temperature.

* * * * *